US006343392B1

(12) United States Patent
Becker et al.

(10) Patent No.: US 6,343,392 B1
(45) Date of Patent: Feb. 5, 2002

(54) ADJUSTING DEVICE FOR A SEAT, COUCH OR A BED

(75) Inventors: Klaus Becker; Rüdiger Ostholt, both of Wetter/Ruhr (DE)

(73) Assignee: Recticel International Bettsysteme GmbH, Holzwickede (DE)

( * ) Notice: Subject to any disclaimer, the term of this patent is extended or adjusted under 35 U.S.C. 154(b) by 0 days.

(21) Appl. No.: 09/511,588

(22) Filed: Feb. 23, 2000

(30) Foreign Application Priority Data

Feb. 25, 1999 (DE) ..... 199 08 084

(51) Int. Cl.[7] ..... A61G 7/00
(52) U.S. Cl. ..... 5/618; 5/616; 5/617
(58) Field of Search ..... 5/618, 617, 616, 5/613, 600; 108/145, 147; 297/75, 90

(56) References Cited

U.S. PATENT DOCUMENTS 4,120,057 A 10/1978 Neumann
4,225,182 A 9/1980 Werner
5,208,928 A * 5/1993 Kuck et al. ..... 5/608
5,860,185 A 1/1999 Ponziani

FOREIGN PATENT DOCUMENTS

DE 32 34 257 12/1983
FR 2 644 998 10/1990

* cited by examiner

*Primary Examiner*—Lynne H. Browne
*Assistant Examiner*—Fredrick Conley
(74) *Attorney, Agent, or Firm*—Cohen, Potani, Lieberman & Pavane

(57) ABSTRACT

An adjusting device for a seat, couch or a bed utilizes a rotatably mounted eccentric in a round disc connected to the motor via a gearing. The round disc has an external tooth system that meshes with an internal tooth system a ring. A rod is connected to the ring is adapted to transmit adjusting force to one of the base sections of the seat, couch or bed. The adjusting device provides a more compact adjustable drive with the feature of single-base drive.

12 Claims, 5 Drawing Sheets

ADJUSTING DEVICE FOR A SEAT, COUCH OR A BED

BACKGROUND OF THE INVENTION

1. Field of the Invention

The invention relates to position adjusting devices, and more particularly to adjusting devices for a seat, a couch or a bed.

2. Description of the Related Art

An adjusting device for beds is known by German Utility Model 88 06 094.2; EP 372 032. The aim being to construct such a device in a more compact form compared with previously known adjusting devices and to configure it in a simpler manner without cable laying and wiring work in order to facilitate the assembly. To this end, it is proposed to arranged known linear drives in a box-shaped housing, adjusting spindles with screwed-on adjusting nuts being mounted in guides of the housing and longitudinal and/or transverse adjusting ribs being provided in order to adjust the housing. In this case, the electric motor is connected via worm gearing to the screw spindle with adjusting nuts, and the nuts bears against an independent bell-crank lever, the arm lengths of which help to determine the length and the height of the housing. The bell-crank lever in this case not only takes up considerable construction space but likewise extends upwards in the initial and end positions, so that the overall height and overall length of the housing become undesirably large. Furthermore, the housing is set up for always driving two base sections, so that a solution for one base section is ruled out from the start.

SUMMARY OF THE INVENTION

The object of the invention is to provide the adjusting drive both in a more compact manner and with the feature of a single-base drive.

This and other objects are achieved according to the invention in that the electric motor is connected via gearing to a rotatably mounted eccentric in a round disc located in the vertical plane and having an external tooth system. The disc is supported in a fixed position relative to the outer frame, such that the external tooth system meshes with a ring of larger internal circumference and having an internal tooth system. The rod for transmitting the adjusting force to a base section is fastened to the ring. As a result, the adjusting drive not only becomes compact, but the feature of using the adjusting drive separately for only one of the base sections is also obtained. The greater compactness is obtained from the resulting flat disc design. The force transmission also takes place only in the lifting direction of the base section. A plurality of such small adjusting drives may be used for base sections of different widths.

In a further embodiment of the invention, provision is made for the electric motor, lying parallel to the outer frame, to be connected to the eccentric via an angular drive. As a result, space is likewise saved and the compactness is increased.

Furthermore, the fact that the angular drive consists of reduction gearing constitutes an improvement. As a result, the requisite speed reduction of the motor can partly take place in the first stage.

The fact that the reduction gearing includes standard worm gearing provides for an economical selection of the components for the first stage of the drive.

Another economical design of the first stage of the drive also results from the fact that the electric motor is designed like a windshield wiper motor from motor vehicles.

In addition, the fact that the electric motor with angular drive is fastened directly to the base plate of the ring having an internal tooth system saves additional construction space.

In yet a further embodiment of the invention, the fixed support for transmitting the torque is designed such that the disc is held on the outer frame in a flexible manner relative to the latter by means of a bar-shaped torque support.

The flexibility may now be configured in such a way that the torque support at the fastening point on the outer frame has an elongated hole for the fastening element or comes to bear on one side. The round disc with the external tooth system on which the torque support is screwed in place, can transmit the eccentric movement to the torque support, which is free to absorb the eccentric movement.

Furthermore, it is advantageous that the eccentric in the round disc is rotatably mounted by means of a rolling or sliding bearing. As a result, the eccentric movement can be transmitted without a large amount of resistance.

The speed to be transmitted by the electric motor to the respective base section, which speed requires considerable deceleration, is provided by virtue of the fact that a reduction ratio is formed from the speed reduction of electric motor/worm gearing and external tooth system/internal tooth system. The internal tooth system having the larger diameter for receiving the external tooth system, which has a smaller diameter.

An optimum adaptation of the speed reduction is obtained from the relationship to the effect that the number of teeth of the worm gearing is $Z1=60$, that of the internal tooth system is $Z2=120$ and that of the external tooth system is $Z3=118$ and the overall reduction ratio is $i=3600:1$.

The range of use of the invention is clearly shown by the fact that the drive, consisting of electric motor and reduction gearing, is assigned as a unit in each case to one or two base sections. As a result, one or more base sections may be equipped with single or twin drives.

The arrangement may also be varied by virtue of the fact that, for a narrow seat or a narrow couch, the drives are fastened in mirror image fashion in each case to the inside of the outer frame.

A further possible variation is obtained by the fact that, for a wide seat or a wide couch, pairs of drives are fastened in mirror image fashion to the two insides of the outer frame.

The various features of novelty which characterize the invention are pointed out with particularly in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

Exemplary embodiments of the invention are shown in the drawings and are described in more detail below. In the drawings.

DETAILED DESCRIPTION OF THE PRESENTLY PREFERRED EMBODIMENTS

Figure 1:
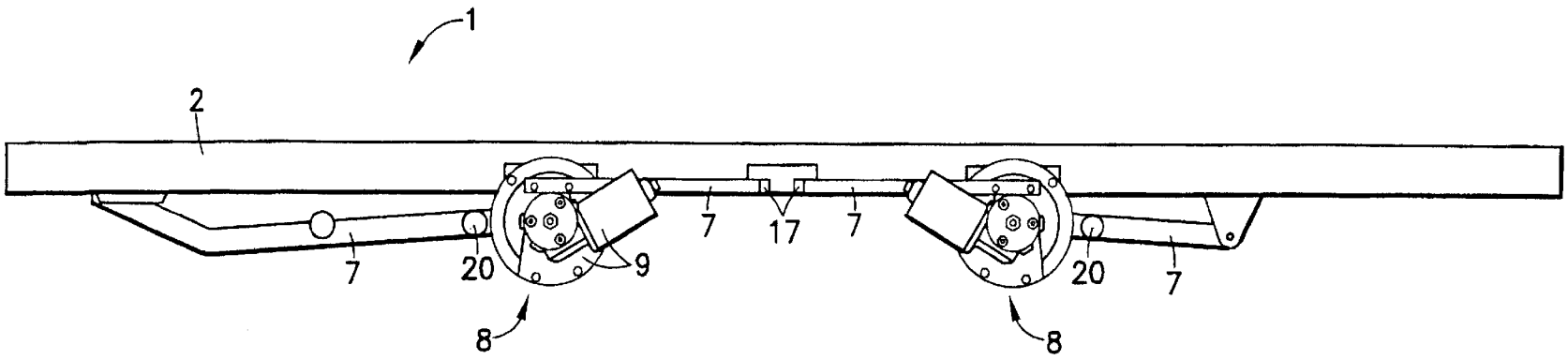
FIG. 1 is a side view of a bed with the drives in the zero position.
Figure 2:
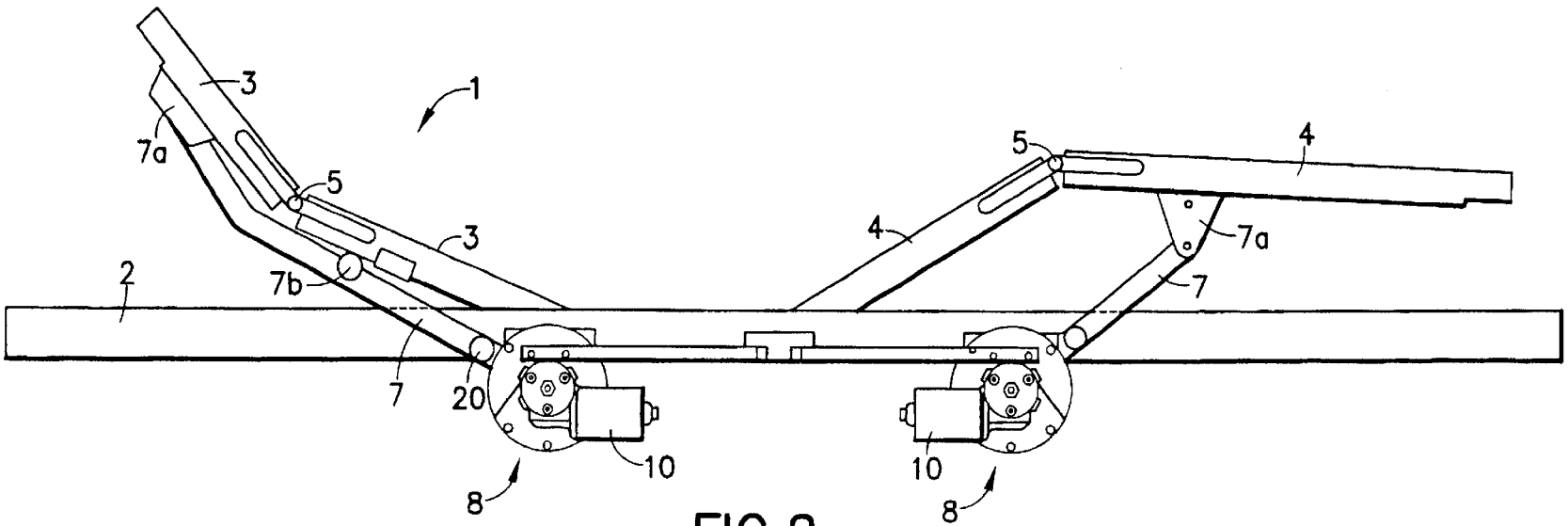
FIG. 2 is the same view as in FIG. 1 with adjusted base sections.

The adjusting device of the present invention is intended and created for a seat 1 (e.g. a car seat) or a couch 1, but primarily for a bed 1, e.g. a hospital bed (FIGS. 1 and 2).

Figure 6:
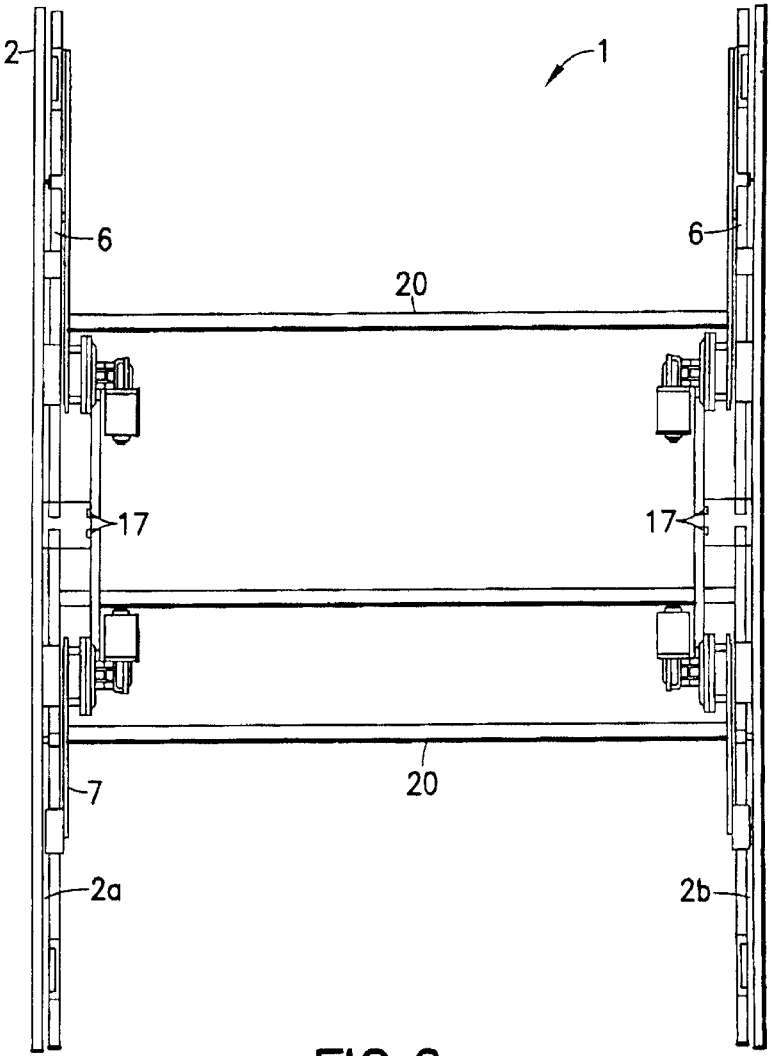
FIG. 6 is a front view of a wide bed.
Figure 5:
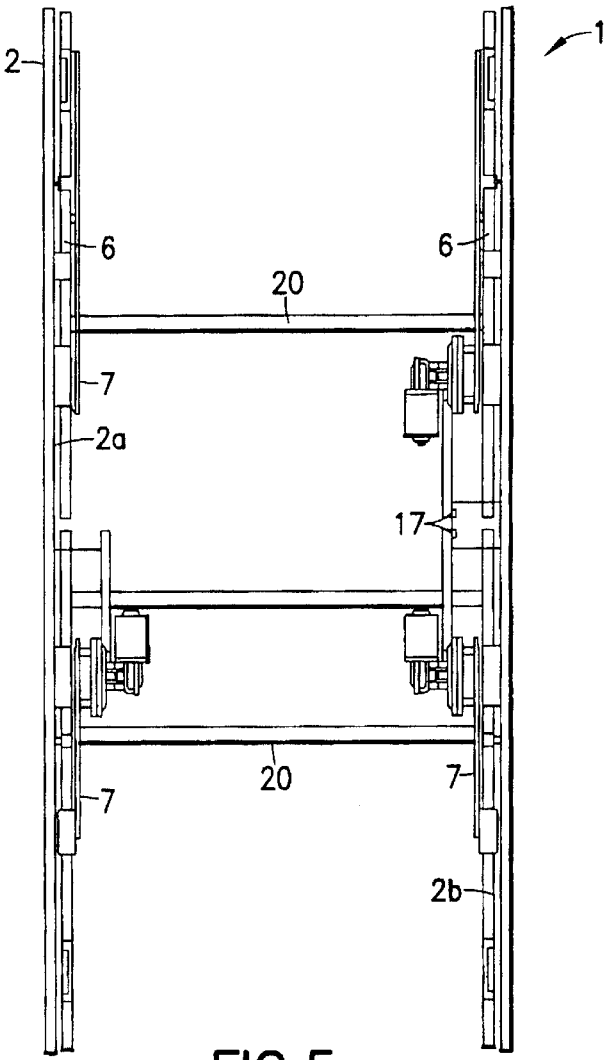
FIG. 5 is a front view of a narrow bed.

Head and/or back base sections 3 and leg base sections 4 are arranged on an outer frame 2 having an inside 2*a* and an opposite inside 2*b* (FIGS. 5 & 6). The head base sections 3 and back base section 3 are connected by means of joints 5 and the leg base sections 4 are likewise connected by means of joints 5 and form an inner frame 6 (FIGS 5 & 6). The inner frame 6 with its base sections 3 and 4, which form a combination on both sides by means of transverse rods, is pivotably mounted on the outer frame 2.

Rods 7 are fastened in each case to the base sections 3, 4 by means of an articulation 7*a*, and are each connected at one end to a drive 8. The drives 8, together with an electric motor 10 and reduction gearing 11, form a unit 9, which may be used in various arrangements.

Via the gearing 11*a*, as reduction gearing 11, the electric motor 10 drives a rotatably mounted eccentric 12. The electric motor 10 is fastened to the sole plate 11*c*. Between the gearing 11*a* and the sole plate 11*c*, distance pieces 11*d* determine the distance, which is fixed by screws 11*e*. The electric motor 10 and the sole plate 11*c* form a unit together with the ring 14 and the base plate 21 (FIGS. 3A & 4A).

Here, the reduction gearing 11 may consist of standard worm gearing 11*b*. A disc 13 having an external tooth system 13*a* meshes with a ring 14 with the base plate 21. The ring 14 having an internal tooth system 14*a* of larger diameter. The rod 7 for transmitting the adjusting force to a base section 3 or 4 is fastened to the ring 14.

Figure 3A:
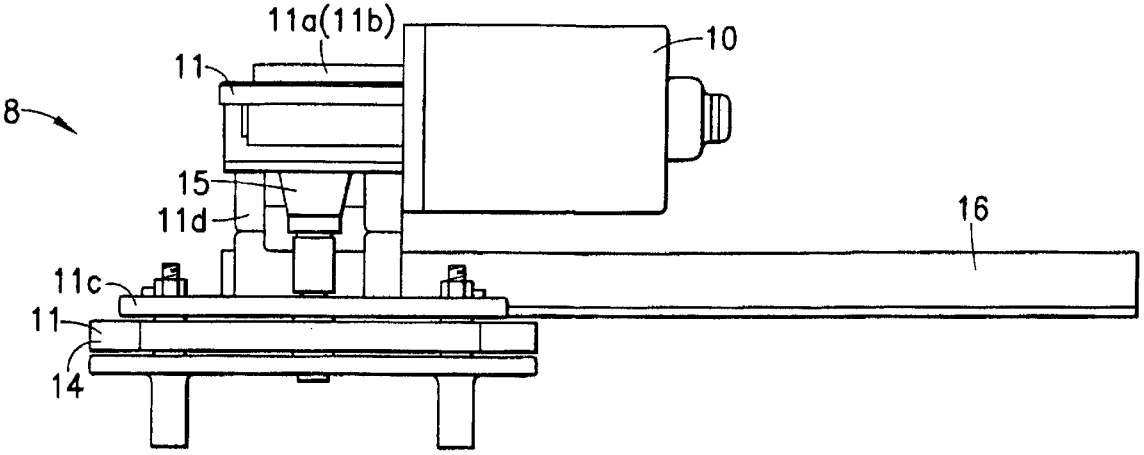
FIG. 3A is a side view of the drive unit with torque support.
Figure 3B:
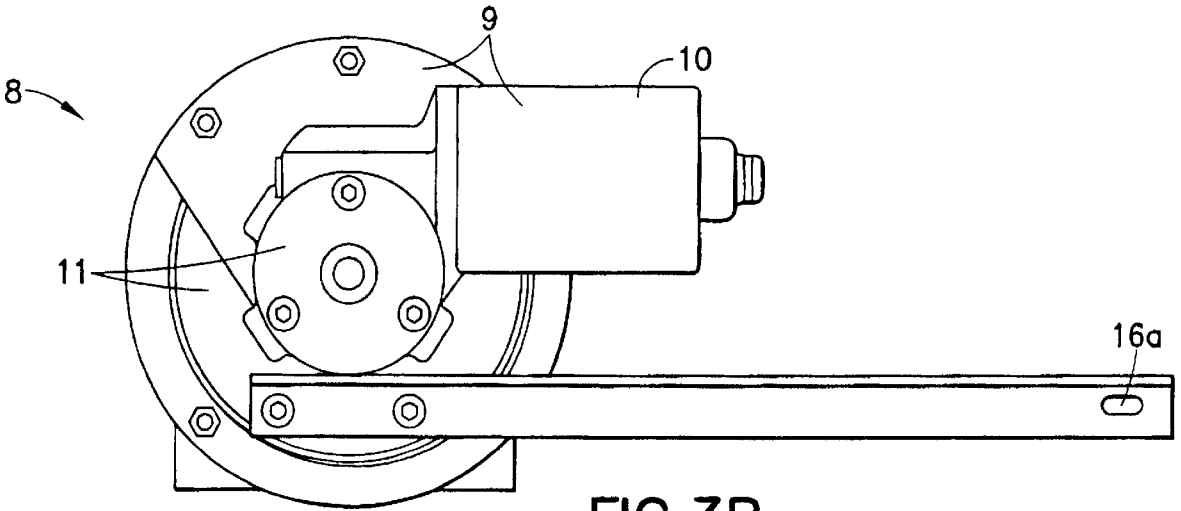
FIG. 3B is a plan view pertaining to the embodiment of FIG. 3A.
Figure 4A:
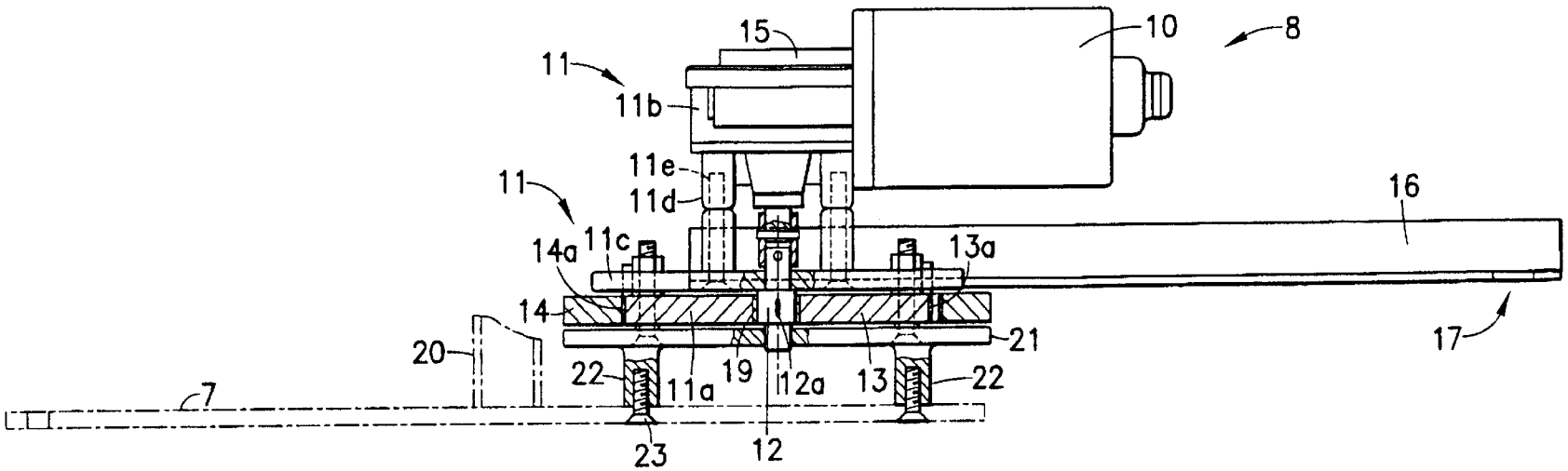
FIG. 4A is a partial section through the drive unit with torque support and lifting rod.
Figure 4B:
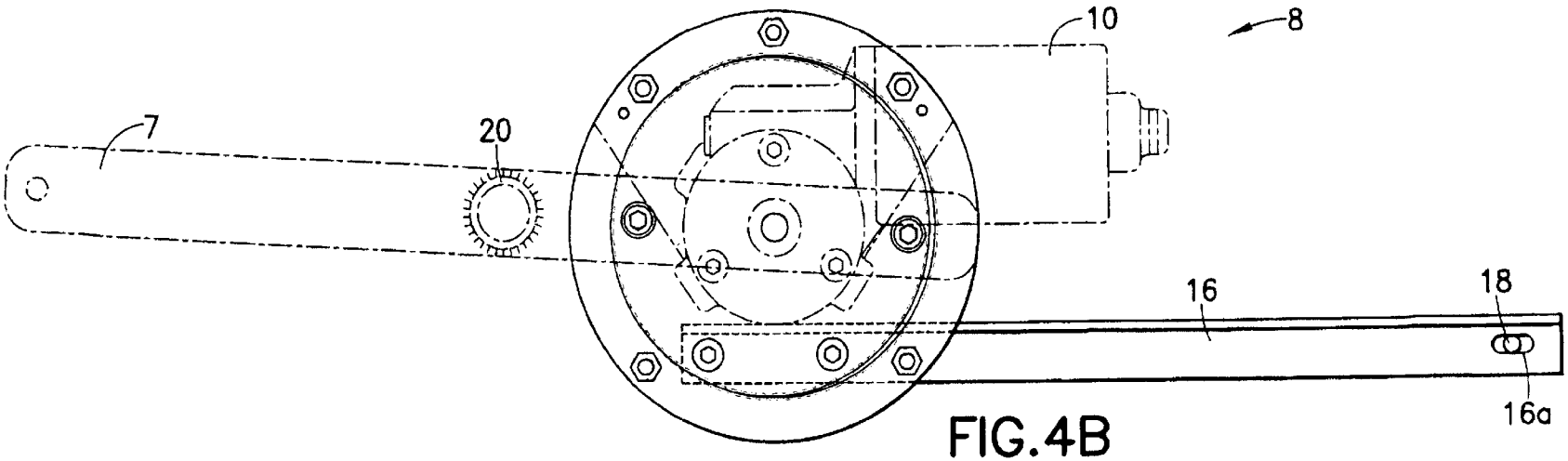
FIG. 4B is a plan view pertaining to the embodiment of FIG. 4A.

The electric motor 10, which according to FIGS. 3A and 3B lies parallel to the outer frame 2, is connected to the eccentric 12 via an angular drive 15. The electric motor 10 may also be designed like a windshield wiper motor for motor vehicles. It is a direct-current motor with an input voltage of 24 volts or 42 volts.

According to FIG. 3A, the electric motor 10 with the angular drive 15 is fastened directly to the sloe plate 11*c* via distance pieces 11*d* and screws 11*e*.

Both the disc 13 and the ring 14 are flat and are guided in a sliding manner with exactly the same thickness between the base plate 21 and the sole plate 11*c*. The eccentric 12 is rotationally guided with equi-axial shanks in each case in the sole plate 11*c* and in the base plate 21. Located between the shanks is the eccentric shank 12*a*, which is rotatably mounted by means of a rolling or sliding bearing 19, which may consist of a needle bearing. During a revolution of the round disc 13, for example, only two teeth on the ring 14 are rotated further. Since the sole plate 11*c* and the ring 14 form a unit, only the round disc 13 with the external tooth system 13*a* moves.

Fastened to the base plate 21 at a distance apart are pillars 22, to which the relevant rod 7 is screwed by means of countersunk screws 23. A transverse rod 20 of the respective base section 3 or 4 is then welded or fastened in another manner to the rod 7.

The disc 13 is supported relative to the outer frame 2 by means of a bar-shaped torque support 16 in an elongated hole 16*a* at a fastening point 17 for a fastening element 18 in a flexible manner in the direction of the elongated hole 16*a*.

Figure 7A:
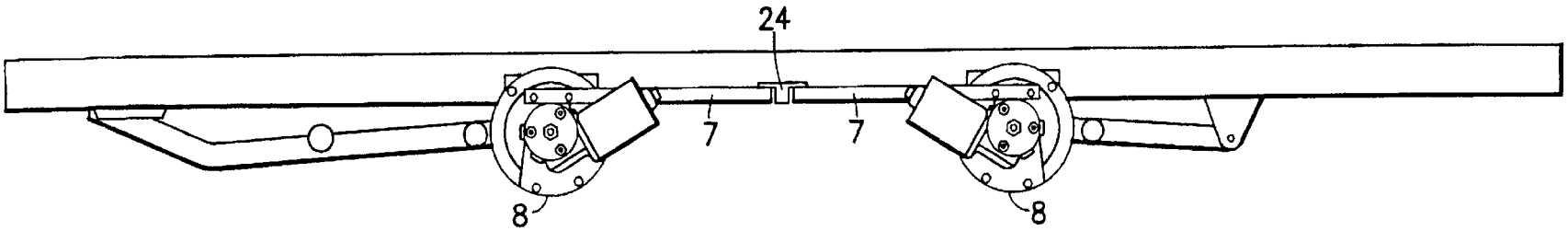
FIG. 7A is the same side view of the bed and the drive with an alternative mounting of the torque support.
Figure 7B:
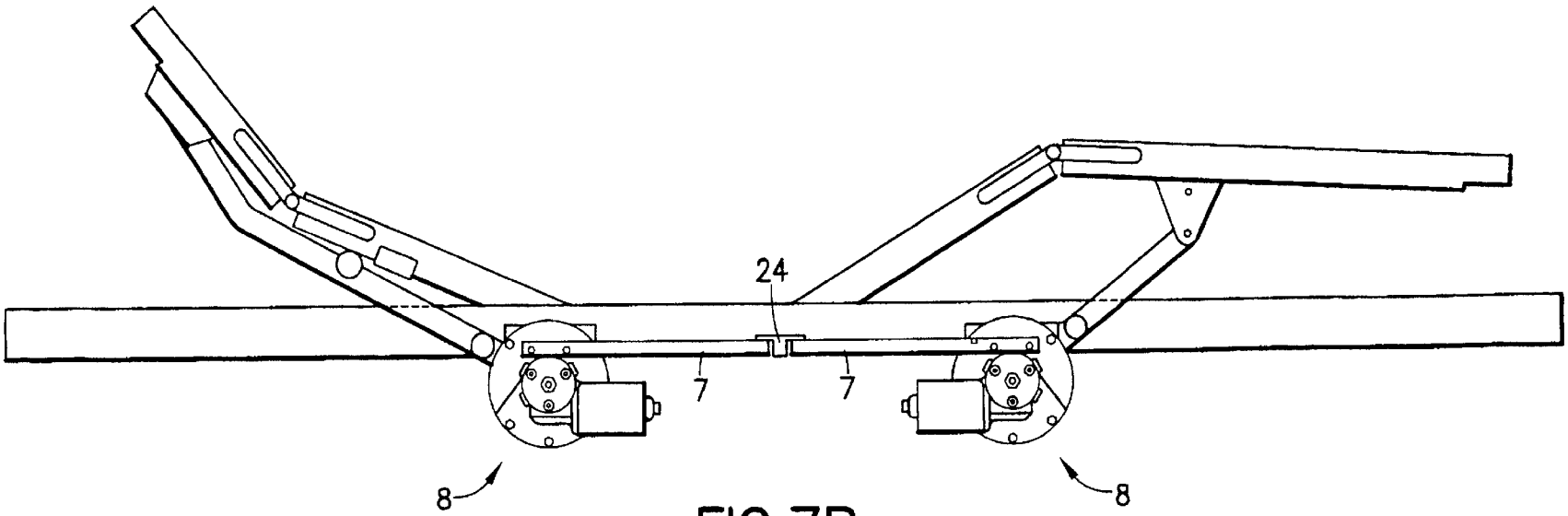
FIG. 7B is the same side view as FIG. 7A after adjustment of the base sections.

In the alternative embodiment shown in FIGS. 7A and 7B, the torque support 16 bears freely in a simple and reliable manner against a T-shaped bearing part 24, so that a finger of the user or of other persons cannot be crushed when the bed 1 is moved downwards.

The reduction ration from the speed reduction of the electric motor 10 and the standard worm gearing 11*b* on the one hand and the external tooth system 13*a* with the internal tooth system 14*a* on the other hand is based on the larger diameter of the internal tooth system 14*a* relative to the smaller diameter of the external tooth systems 13*a*. The number of teeth of the worm gearing may be selected to be, for example, Z1=60, that of the internal tooth system may be selected to be Z2=120 and that of the external tooth system may be selected to be Z3=118. The number of teeth is therefore different by two teeth. The resulting overall ratio is i=3600:1.

The drive 8 (FIGS. 5 and 6), consisting of the electric motor 10 and the reduction gearing 11, is formed as a unit 8 and is assigned in each case to a base section 3 or 4 respectively.

In the case of a narrow seat 1 or narrow couch 1, drives 8, 8 are in each case arranged in mirror image fashion on the inside 2*a* of the outer frame 2.

For a wide seat 1 or a wide couch (e.g. for two persons), pairs of drives 8 are fastened in mirror image fashion to the two insides 2*a* and 2*b* of the outer frame 2.

Furthermore, it is important that the transverse rod 20 connecting the rods 7 does not lie in the pivot axis of the base section 3 or 4 respectively. On the contrary, the pivot axis lies in the center axis of the drives 8, so that the positions of the respective drive which are shown in FIGS. 1 and 2 and also in FIGS. 7A and 7B are set during the adjustment.

The invention is not limited by the embodiments described above which are presented as examples only but can be modified in various ways within the scope of protection defined by the appended patent claims.

We claim:

1. A combination of: one of a seat, couch and a bed having a plurality of head/back base sections being connected to one another by joints, at least one of the head/back base sections being adjustable, wherein leg base sections form an inner frame and are driven by rods which are connected to a drive and are linked to individual leg base sections, the drive including a reduction gearing and an electric motor; and an adjusting device comprising:

a round disc located in a vertical plane and having an external tooth system with an external circumference and a rotatably mounted eccentric having a gearing connection to the motor, said disc being supported in a fixed position relative to an outer frame;

a ring fastened to one of the head/back and leg base sections and having an internal tooth system and an internal circumference larger than said external circumference of said round disc, said external tooth system of said disc meshing with said internal tooth system;

a rod for transmitting an adjusting force to the one of the head/back and leg base sections connected to said ring; and an angular drive for connecting the electric motor to said eccentric, the electric motor being positioned parallel to the outer frame, a larger diameter of said internal tooth system forming a reduction ratio with the external tooth system from a speed reduction of the electric motor/worm gearing, the worm gearing comprising 60 teeth, the internal tooth system comprising 120 teeth and the external tooth system comprising 118 teeth, wherein an overall reduction ratio i=3600:1.

2. The combination in accordance with claim 1, wherein said angular drive consists of the reduction gearing.

3. The combination in accordance with claim 1, wherein the reduction gearing includes worm gearing.

4. The combination in accordance with claim 1, wherein said ring further comprises a base plate, wherein the electric motor with said angular drive is connected directly to said base plate.

5. The combination in accordance with claim 1, further comprising a bar-shaped torque support for securing said disc onto the outer frame in a flexible manner.

6. The combination in accordance with claim 5, wherein said torque support comprises an elongated hole, wherein the outer frame comprises a fastening point and said elongated hole is positioned on said torque support at said fastening point and is adapted to receive a fastening element therethrough.

7. The combination in accordance with claim 1, further comprising a sliding bearing adapted to rotatably mount said eccentric in said round disc.

8. The combination in accordance with claim 1, further comprising a rolling bearing adapted to rotatably mount said eccentric in said round disc.

9. The combination in accordance with claim 1, wherein the drive comprising the electric motor and reduction gearing is assigned as a unit in each case to at least one base section.

10. The combination in accordance with claim 9, wherein the drives are fastened to an inside of the outer frame in a mirror image manner for narrow seats and couches.

11. The combination in accordance with claim 9, wherein a pair of drives are fastened to two insides of the outer frame for wide seats and couches.

12. A combination for one of a seat, couch and a bed having a plurality of head/back base sections being connected to one another by joints, at least one of the head/back base sections being adjustable, wherein leg base sections form an inner frame and are driven by rods which are connected to a drive and are linked to individual leg base sections, the drive including a reduction gearing and an electric motor, and an adjusting device comprising:

a round disc located in a vertical plane and having an external tooth system with an external circumference and a rotatably mounted eccentric having a gearing connection to the motor, said disc being supported in a fixed position relative to an outer frame;

a ring fastened to one of the head/back and leg base sections and having an internal tooth system and in internal circumference larger than said external circumference of said round disc, said external tooth system of said disc meshing with said internal tooth system;

a rod for transmitting an adjusting force to the one of the head/back and leg base stations connected to said ring; and a bar-shaped torque support for securing said disc onto the outer frame in a flexible manner, the torque support comprising an elongated hole, wherein the outer frame comprises a fastening point and said elongated hole is positioned on said torque support at said fastening point and is adapted to receive a fastening element therethrough.

* * * * *